United States Patent [19]

Shelton, Jr.

[11] Patent Number: 4,715,513

[45] Date of Patent: Dec. 29, 1987

[54] TOXIC MATERIAL STORAGE VESSEL CONTAINMENT SYSTEM

[76] Inventor: Amos H. Shelton, Jr., P.O. Box 327, Calvert City, Ky. 42029

[21] Appl. No.: 806,431

[22] Filed: Dec. 9, 1985

[51] Int. Cl.[4] ..... B65D 6/38; B65D 25/18

[52] U.S. Cl. ..... 220/469; 220/5 A; 220/18; 250/506.1

[58] Field of Search ..... 220/469, 466, 441, 442, 220/408, 4 B, 4 E, 5 A, 85 R, 85 S, 23.83, 1 C, DIG. 6, 18; 250/506.1, 507.1; 252/633

[56] References Cited

U.S. PATENT DOCUMENTS

| | | | |
|---|---|---|---|
| 1,773,930 | 8/1930 | Athon | 220/5 A |
| 2,050,096 | 8/1936 | Johnson | 222/108 |
| 2,208,621 | 7/1940 | Ball et al. | 220/1 |
| 2,339,303 | 1/1944 | Tillery | 220/DIG. 6 X |
| 2,924,352 | 2/1960 | Santner et al. | 220/18 |
| 3,111,074 | 11/1963 | Kennard, Jr. et al. | 220/23.83 X |
| 3,322,141 | 5/1967 | Gans, Jr. | 137/312 |
| 3,848,765 | 11/1974 | Dürkop | 220/18 X |
| 3,940,940 | 3/1976 | Barrett | 61/1 R |
| 3,962,587 | 6/1976 | Dufrane et al. | 250/506.1 |
| 3,995,472 | 12/1976 | Murray | 73/40 |
| 4,110,947 | 9/1978 | Murray et al. | 52/249 |
| 4,245,748 | 1/1981 | Kvamsdal | 220/1 C |
| 4,330,711 | 5/1982 | Ahner et al. | 220/506.1 |
| 4,359,167 | 11/1982 | Fouss et al. | 220/72 |
| 4,377,509 | 3/1983 | Haynes et al. | 252/633 |
| 4,481,975 | 11/1984 | Buckley | 220/441 X |
| 4,560,069 | 12/1985 | Simon | 250/506.1 X |
| 4,561,292 | 12/1985 | Dugnale et al. | 220/441 X |
| 4,594,513 | 6/1986 | Suzuki et al. | 220/466 X |

*Primary Examiner*—Steven M. Pollard
*Attorney, Agent, or Firm*—Maurice L. Miller, Jr.

[57] ABSTRACT

A system for the containment of a toxic material storage vessel is disclosed. In one example, a cylindrically shaped hollow jacket having upper and lower half sections are fastened together along flanged borders to form a leak resistant seal for enclosing a conventional toxic material storage vessel therein. Elongated channels extend the length of the jacket along upper and lower surfaces of the upper and lower half-sections, respectively. The channels communicate with the interior of the jacket and are tilted relative to the horizontal such that lighter-than-air gases escaping from the vessel migrate along the upper channel and accumulate at one end of the jacket and such that a liquid leaking from the vessel gravitates along the lower channel and accumulates at the same end of the jacket where conventional gas and liquid detecting means is employed to detect the presence of such accumulated liquid and gases. A second example comprises a cylindrically shaped jacket mounted on one end and containing a raised disc shaped base eccentrically located relative to a longitudinal axis of the jacket upon which a conventional toxic material storage vessel rests, whereby a crescent shaped depression is formed in a lower end portion of the jacket for accumulating liquid leakage from the vessel.

3 Claims, 4 Drawing Figures

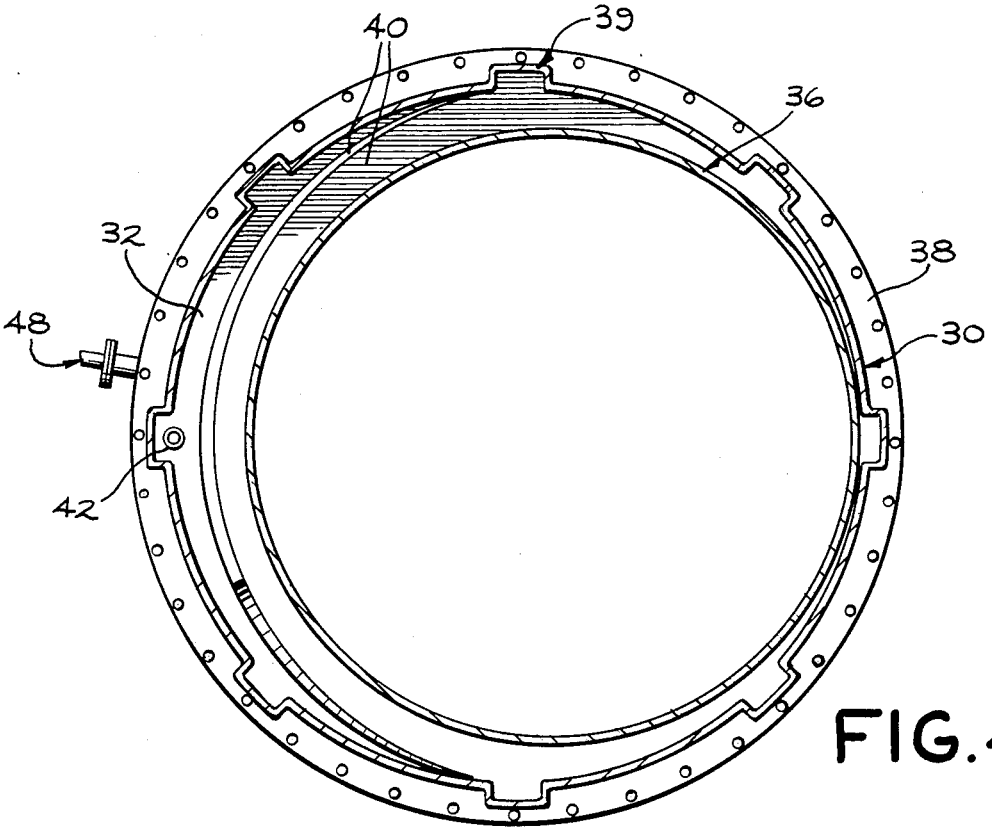
FIG. 4
FIG. 2
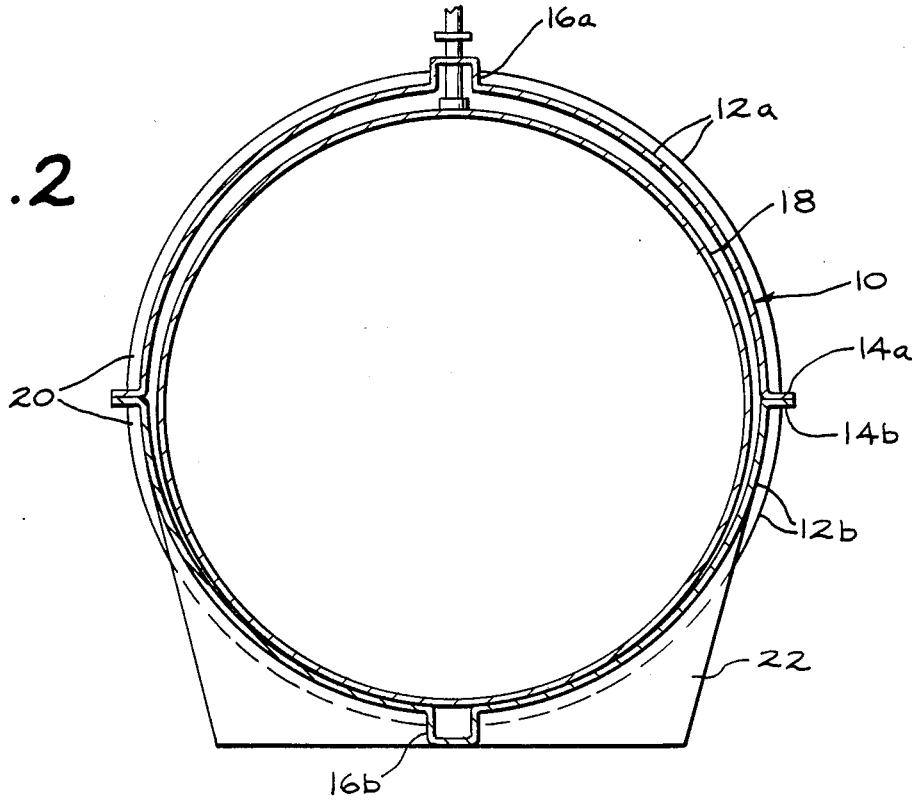

TOXIC MATERIAL STORAGE VESSEL CONTAINMENT SYSTEM

BACKGROUND OF THE INVENTION

This invention relates generally to means for inhibiting leakage of liquids, gases and vapors from storage vessels containing toxic materials. More particularly, this invention relates to a jacketing system adapted to confine a toxic material containing storage vessel therein which tends to entrain liquid and gas leaks from the vessel into an accumulation section of the jacket wherein the leakage can be detected and monitored.

Such systems, generally speaking, are known in the prior art. See, for example, the double wall underground storage tank disclosed in U.S. Pat. No. 4,110,947 issued to James T. Murray, et al. on Sept. 5, 1978. Other prior art patents of interest in this field include U.S. Pat. No. 3,995,472 issued to James T. Murray on Dec. 7, 1976; U.S. Pat. No. 2,924,352 issued to R. R. Santner, et al. on Feb. 9, 1960; U.S. Pat. No. 4,245,748 issued to Rolf Kvamsdal on Jan. 20, 1981; U.S. Pat. No. 2,208,621 issued to T. M. Ball, et al. on July 23, 1940; U.S. Pat. No. 3,322,141 issued to D. Gans, Jr., et al. on May 30, 1967; U.S. Pat. No. 2,531,159 issued to W. G. Rowell on Nov. 21, 1950; U.S. Pat. No. 2,050,096 issued to C. W. Johnson on Aug. 4, 1936; and U.S. Pat. No. 3,940,940 issued to J. E. Barrett on Mar. 2, 1976.

SUMMARY OF THE INVENTION

It is an object of my invention to provide a toxic material containment system or jacketing system for a toxic liquid, vapor and/or gas containing vessel.

It is another object of my invention to provide such a system wherein liquid and gas leakage from the vessel will be contained in an accumulation section of the jacketing system where it can be detected and monitored.

Briefly, in accordance with my invention, I provide a toxic material storage vessel containment system which includes a cylindrically shaped hollow jacket having upper and lower half sections which can be removably fastened together in a leak resistant manner for enclosing a conventional toxic material storage vessel therein. I also provide a first longitudinally extending channel running the length of the lower half section which is connected to the bottom of the lower half section and which communicates with the interior of the jacket along substantially its entire length. The first channel is tilted so that when the longitudinal axis of the jacket is horizontal, a liquid in the first channel will gravitate toward one end of the jacket. Lastly, I provide a leak detecting means disposed in one end portion of the jacket which extends into the first channel for detecting the presence of a liquid therein which has leaked from the vessel.

These and other objects, features and advantages of my invention will become obvious to those skilled in the art from the following detailed description and drawings upon which, by way of example, only two preferred embodiments of my invention are illustrated.

BRIEF DESCRIPTION OF THE DRAWINGS

FIG. 2 shows a cross-sectional and elevation view of the system of FIG. 1 as viewed along cross-section lines 2—2 of the latter figure.

FIG. 4 shows a cross-sectional plan view of the system of FIG. 3 as viewed along lines 4—4 of the latter figure.

DESCRIPTION OF THE PREFERRED EMBODIMENT

Figure 1:
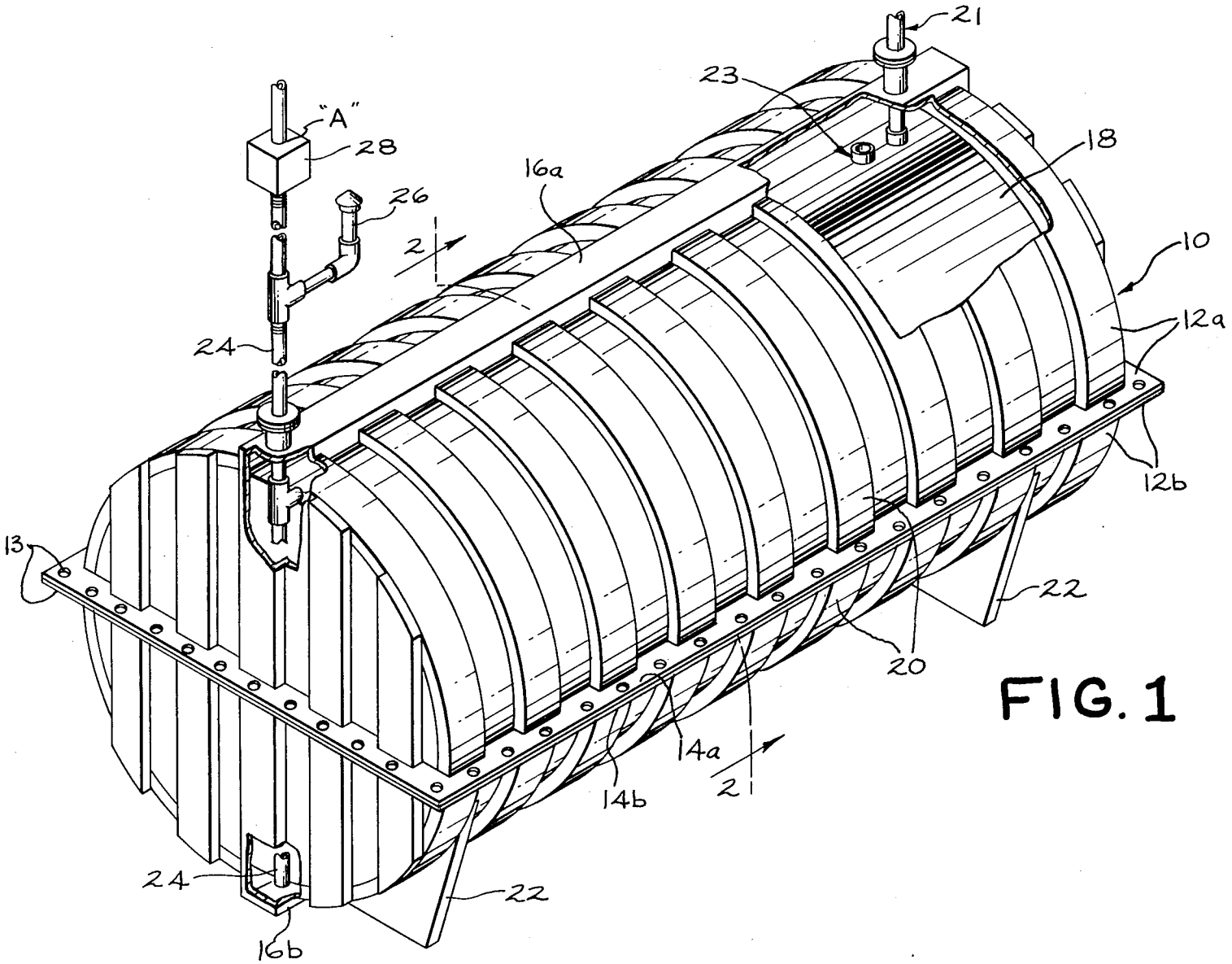
FIG. 1 shows a perspective view of a toxic fluid containment system thus illustrating one preferred embodiment of my invention.

Referring now to drawing FIGS. 1–2, there is shown, in one preferred embodiment of my invention, a horizontally elongated, generally cylindrically shaped hollow jacket 10 having upper and lower half-sections 12*a,b*, respectively, which are securely bolted together through various holes 13 spaced along matching flanges 14*a,b* to form a fluid tight, leak proof seal. The half-sections 12*a,b* contain longitudinally extending channels 16*a,b* forming accumulation spaces for gases and liquids, respectively, which might leak from a cylindrically shape toxic substance storage vessel 18 enclosed within the jacket 10. The longitudinally extending channels 16*a,b* are connected by a plurality of spaced apart, circumferentially extending channels 20 which also function as structural reinforcing ribs for the half-sections 12*a,b*. A pair of support legs 22 for the jacket 10 are connected to the lower half-section 12*b*. The storage vessel 18 may be filled or emptied while enclosed in the jacket 10 by means of the pipe 21, all in a conventional and well known manner. A leak tight outlet, not shown, is also provided for a tank safety vent 23.

A pipe 24 for detecting the leakage of liquid from the storage vessel 18 extends downwardly through one end portion of the channel 16*a*, thence along the outside end surface of the vessel 18 into a corresponding end portion of the channel 16*b* such that its open lower end will engage any liquid collecting at that end of the channel 16*b*. While it can not be visualized due to the small scale of the subject drawings, the ceiling or upper surface of the channel 16*a* should be inclined slightly upwardly (moving from right to left in FIG. 1) so that lighter than air gases which leak from the vessel 18 into the channel 16*a* will migrate toward and accumulate in the left hand end portion of the channel 16*a* as viewed, whereby such gases will be vented to above-ground atmosphere by a vent system 26 attached to the leak detecting pipe 24. Any one of a number of well-known vapor or gas detectors 28 may be connected to the pipe 24 as claimed. Similarly, the base of the channel 16*b* should be inclined slightly downwardly moving from right to left in FIG. 1 so that toxic liquids which leak from the vessel 18 will flow into a left end portion of the channel 16*b* where they will accumulate and be subject to being sensed by the leak detecting pipe 24. Various well known types of liquid leak detection systems usable with the system of the present example include calibrated gauge sticks, suction line monitors, float actuated mercury switch devices, electronic liquid sensors and the like. Gas and vapor sensors suitable for use with the system of the present example include pumped detector tube systems, filament type combustible gas indicators, electrochemical polarographic gas indicators, infared spectometers, gas chromotographic analyzers and the like.

Figure 3:
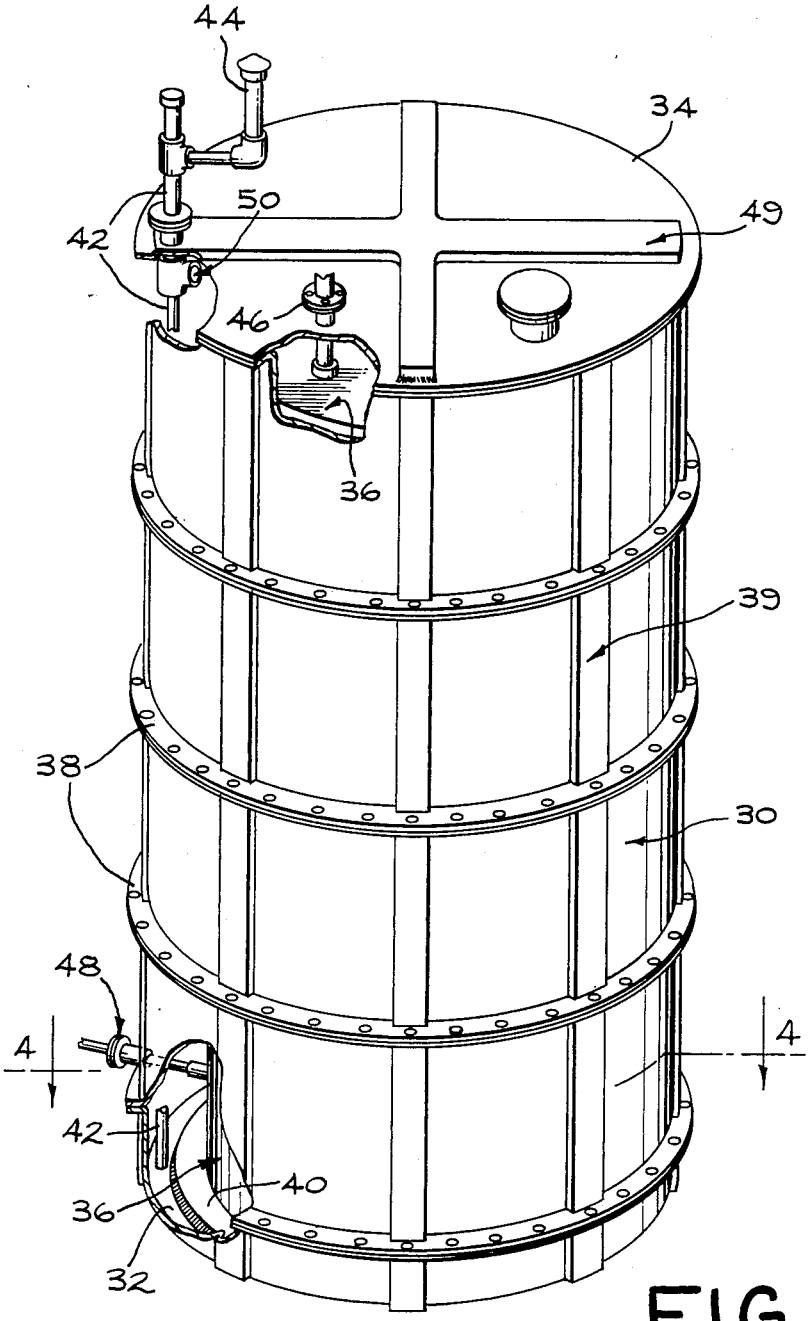
FIG. 3 shows a perspective view of a toxic fluid containment system thus illustrating another preferred embodiment of my invention.

Referring now to FIGS. 3–4, there is shown, in another preferred embodiment of my invention, a cylindrically shaped jacket 30 having a flat circular bottom surface 32 and removable upper lid 34 in which is disposed a conventional cylindrically shaped toxic material storage vessel 36. The jacket 30 is constructed of multiple cylindrically shaped sections containing flanges 38 bolted together to form a rigid assembly. A plurality of vertically extending, horizontally spaced, raised ribs 39 are formed around the jacket 30. The vessel 36 rests upon a raised base 40 which is more or less circular but eccentric with respect to the bottom surface 32 as seen most clearly in FIG. 4. Any liquid leaking from the sides of the vessel 36 will spill over the base 40 into a crescent shaped depression 32 where its presence can be detected through a leak detecting pipe 42 which is connected to an associated leak detecting system of conventional type located outside of the vessel 36. A vent pipe 44 connected to an upper end portion of the pipe 42 permits gases escaping from the vessel 36 to be vented to ambient atmosphere. The storage vessel 36 may be filled and emptied while enclosed in the jacket 30 by means of one or more pipes such as the pipe 48, all in a conventional and well known manner. The lid 34 contains a leak tight outlet for conventional storage tank safety vents 46 and a pair of ribs 49 intersecting in an X-configuration. The ribs 49 form hollow channels on the underside of the lid 34 similar to the channels formed on the interior of the ribs 39 (See FIG. 4). The channels in the ribs 49 communicate with the upper ends of the channels in four of the vertically extending ribs 39 to permit circulation of lighter-than-air gases and vapors which have leaked from the vessel 36 into a port 50 in the pipe 42.

The materials from which the system of my invention may be constructed depend upon the nature of the toxic materials to be stored within them. Such materials may range from metals such as steel, stainless steel and the like to plastics such as high density polyethylene to synthetic composites such as fiberglass, graphite composite and the like depending upon the toxic material to be stored and the anticipated temperature and pressure conditions within the jacket under conditions of actual use. When necessary, the annular space between the outer surface of the storage vessel and the jacket of my invention may be filled in any conventional manner with inert granular material such as sand or vermiculite to provide stability, restrict internal movement of the storage vessel and provide insulation as necessary. In addition, heat exchanger coils may be embedded in the inert materials in the annular space between the vessel and jacket to provide temperature control of the stored substance.

Although the present invention has been described with respect to specific details of certain preferred embodiments thereof, it is not intended that such details limit the scope and coverage of this patent other than as specifically set forth in the following claims.

I claim:

1. A toxic material storage vessel containment system comprising a cylindrically shaped hollow jacket having a flat circular bottom surface, a removable circular lid forming an upper surface for said jacket enclosing a conventional toxic material storage vessel therein, a plurality of vertically extending ribs formed in and spaced around said jacket and defining channels therein which communicate with the interior of said jacket, a raised disc shaped base eccentrically located relative to the vertical axis of said jacket and mounted on said bottom surface so as to be tangent to a single vertical line along the inside curved surface of said jacket, whereby a crescent shaped depression is formed between an arcuate portion of said jacket and a corresponding arcuate portion of said base for accumulating a liquid leaking from said vessel, and leak detecting means mounted on said jacket and extending into said depression for detecting the presence of liquid which has leaked from said vessel.

2. The system of claim 1 wherein said jacket comprises a plurality of cylindrically shaped sections containing joined flanges.

3. The system of claim 1 further comprising at least one pair of elongated raised ribs formed on said lid and defining channels therein which communicate with the channels defined by at least some of said vertically extending channels.

* * * * *